US007123852B2

(12) United States Patent
Tomizawa

(10) Patent No.: US 7,123,852 B2
(45) Date of Patent: Oct. 17, 2006

(54) IMAGE FORMING APPARATUS HAVING POSITIONED CLEANING UNIT FOR IMAGE TRANSFER BELT POSITIONED WITH RESPECT TO TONER PATCH DETECTING MEMBER AND TONER IMAGE TRANSFER MEMBER

(75) Inventor: Takeshi Tomizawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/870,240

(22) Filed: Jun. 16, 2004

(65) Prior Publication Data

US 2005/0008404 A1 Jan. 13, 2005

(30) Foreign Application Priority Data

Jul. 11, 2003 (JP) ..... 2003-195664

(51) Int. Cl.
*G03G 15/00* (2006.01)

(52) U.S. Cl. ..... 399/49

(58) Field of Classification Search ..... 399/49, 399/66, 71–72, 123, 297, 307, 308, 345, 399/101

See application file for complete search history.

(56) References Cited

U.S. PATENT DOCUMENTS 5,630,194 A * 5/1997 Fujita et al. ..... 399/38
5,708,928 A * 1/1998 Fukunaga ..... 399/123
5,983,042 A * 11/1999 Nagata et al. ..... 399/45
6,088,565 A * 7/2000 Jia et al. ..... 399/302
6,112,037 A * 8/2000 Nagata et al. ..... 399/45
6,885,842 B1 * 4/2005 Sawai ..... 399/302

FOREIGN PATENT DOCUMENTS

JP 05088590 A * 4/1993
JP 2001-305873 A 11/2001
JP 2002-062709 A 2/2002
JP 2002062709 A * 2/2002
JP 2003140473 A * 5/2003

* cited by examiner

*Primary Examiner*—Quana Grainger
(74) *Attorney, Agent, or Firm*—Canon U.S.A. Inc I.P. Div

(57) ABSTRACT

An image forming apparatus having an image forming unit for forming toner images on an image carrier, a transfer unit for transferring an image on an image carrier onto a transfer medium, a detecting unit for detecting a toner image for detection on the image carrier, and a cleaning unit having a cleaning member that comes in and out of contact with the surface of the image carrier, wherein the cleaning unit is disposed downstream of the detecting unit and upstream of the transfer unit in the traveling direction of the image carrier, and the cleaning member is brought in contact with the image carrier when removing a toner image for detection on the image carrier.

4 Claims, 9 Drawing Sheets

IMAGE FORMING APPARATUS HAVING POSITIONED CLEANING UNIT FOR IMAGE TRANSFER BELT POSITIONED WITH RESPECT TO TONER PATCH DETECTING MEMBER AND TONER IMAGE TRANSFER MEMBER

BACKGROUND OF THE INVENTION

1. Field of the Invention

The present invention relates to an image forming apparatus, and, more specifically, the invention relates to a method for cleaning toner contaminating an image carrier or an intermediate transfer unit.

2. Description of the Related Art

There are known image forming apparatuses, such as copy machines and printers, having a plurality of image forming units that emit light modified according to the data recorded on an image carrier (i.e., a photoreceptive drum) from a laser beam unit or a light emitting element such as an LED to form an electrostatic latent image and to develop the electrostatic latent image through an electrophotographic process and transfer this image onto a receptor such as transfer paper or an intermediate transfer belt.

Such an image forming apparatus forms a color image on a receptor such as transfer paper by disposing the transfer paper on a transfer belt and transferring an image for a first color onto the transfer paper by bringing the transfer paper close to or in contact with an image forming unit for the first color. Subsequently, an image for a second color is transferred over the first image on the transfer paper by bringing the transfer paper close to or in contact with an image forming unit for the second color. The same steps are repeated for transferring images for the third and fourth colors over the first and second images formed on the transfer paper.

There are other image forming apparatuses that transfer images for the first to fourth colors in sequence onto an intermediate transfer belt, which is also a receptor, and then transfers the image of the four colors simultaneously onto transfer paper to form a color image.

For such a known image forming apparatus, each color image formed on each photoreceptive drum is occasionally become out of register on the transfer paper or the intermediate transfer unit because by an error in the mechanical attachment of the photoreceptive drums, an error in the light path length of the laser beams, a change in the light path, or warping of the LED due to the ambient temperature.

Therefore, for a known image forming apparatus, pattern images for correcting the registration of the images of each color are formed on each photoreceptive drum and, then, are transferred to the transfer belt or intermediate transfer belt. By reading these pattern images by a CCD sensor, incorrect registration of each color image on the photoreceptive drums is detected. According to the detected results, change in the light path length or change in the light path are compensated for by electrically correcting the image signals or by moving the mirror installed in the midst of the light path of the laser beam.

To improve the stability of the color and density of the overlaid color images formed by a known image forming apparatus, pattern images (patch images) printed with a toner having a predetermined density are formed on the intermediate transfer belt and are read by a detecting unit to determine whether or not the density of a images are within a predetermined limit. When the density greatly exceeds the limit, the density of toner included in a developer and/or the bias voltage applied to a primary charged unit is adjusted.

Japanese Patent Laid-Open No. 2002-62709 discloses a transfer belt cleaning unit and an intermediate transfer belt cleaning unit for efficiently removing pattern images, which are used for the registration and/or for stabilizing the density of toner, formed on a transfer belt or an intermediate transfer belt.

Furthermore, Japanese Patent Laid-Open No. 2001-305873 discloses a cleaning unit for efficiently cleaning the pattern images for adjusting the registration or for stabilizing the density of the toner, wherein the toner of the pattern images on the intermediate transfer belt are removed after the toner is electrically neutralized by a neutralizing unit.

Unfortunately, for such a known image forming apparatus, the toner of the pattern image formed on the intermediate transfer belt may contaminate units in contact with and/or in the vicinity of the intermediate transfer belt. Moreover, for an image forming apparatus that forms a toner image on an intermediate transfer belt, the toner of the image might contaminate units in contact with and/or in the vicinity of the intermediate transfer belt when the operation of the image forming apparatus is resumed after image formation is interrupted due to unsuccessful delivery of a recording material.

When an image is formed after the toner contaminates a unit, the back side or the edges of the recording material may be smeared with the toner. In such a case, the unit soiled with toner must be removed and cleaned.

For an image forming apparatus having a plurality of photoreceptive drums 1*a*, 1*b*, 1*c*, and 1*d*, as illustrated in FIG. 8 or 9, a secondary transfer roller 57 or 82, which is always in contact with an intermediate transfer belt 51 and transfers a toner image on the intermediate transfer belt onto a recording material, may be contaminated by the toner. In such a case, the secondary transfer roller 57 or 82 has to be removed and cleaned. To remove and clean the secondary transfer roller 57 or 82 is not preferable because of the negative impact caused by the removal and the decrease in productivity.

For an image forming apparatus having a transfer fixing unit 80 with a heat source, as illustrated in FIG. 9, the operation of the apparatus may be interrupted due to failure of delivering pattern images or a recording material. When the operation of the apparatus is resumed, the residual toner on the intermediate transfer belt passes the vicinity of the heat source and melts on the intermediate transfer belt. The molten toner adheres to the intermediate transfer belt and becomes difficult to remove it from the intermediate transfer belt.

SUMMARY OF THE INVENTION

The present invention has taken into consideration the above-mentioned problems. It is an object of the present invention to provide an image forming apparatus capable of removing toner from an image carrier more efficiently.

A preferable image forming apparatus for achieving the above-mentioned object, comprises image forming means for forming a toner image on an image carrier, transfer means for transferring the toner image on the image carrier onto a transfer medium, detecting means for detecting a toner image for detection formed on the image carrier, and cleaning means having a cleaning device that is capable of coming into and out of contact with the image carrier, wherein the cleaning means is disposed downstream of the detecting unit and upstream of the transfer means in the moving direction of the image carrier and the cleaning member comes in contact with the surface of the image carrier when cleaning the detection toner image on the image carrier.

Another preferable image forming apparatus, comprises, image forming means for forming a toner image on an image carrier, transfer means for transferring an image on the image carrier onto a transfer medium, cleaning means that is disposed downstream of the image forming means and upstream of the transfer means in the moving direction of the transfer means and that comes in and out of contact with the surface of the image carrier, and controlling means for controlling a cleaning operation by moving the image carrier in a direction opposite to the moving direction for image formation, bringing the cleaning means into contact with the image carrier, and moving the image carrier in the moving direction for image formation, when the operation of the image forming apparatus is resumed after image formation is interrupted.

Further objects, features and advantages of the present invention will become apparent from the following description of the preferred embodiments (with reference to the attached drawings).

DESCRIPTION OF THE PREFERRED EMBODIMENTS

Figure 1:
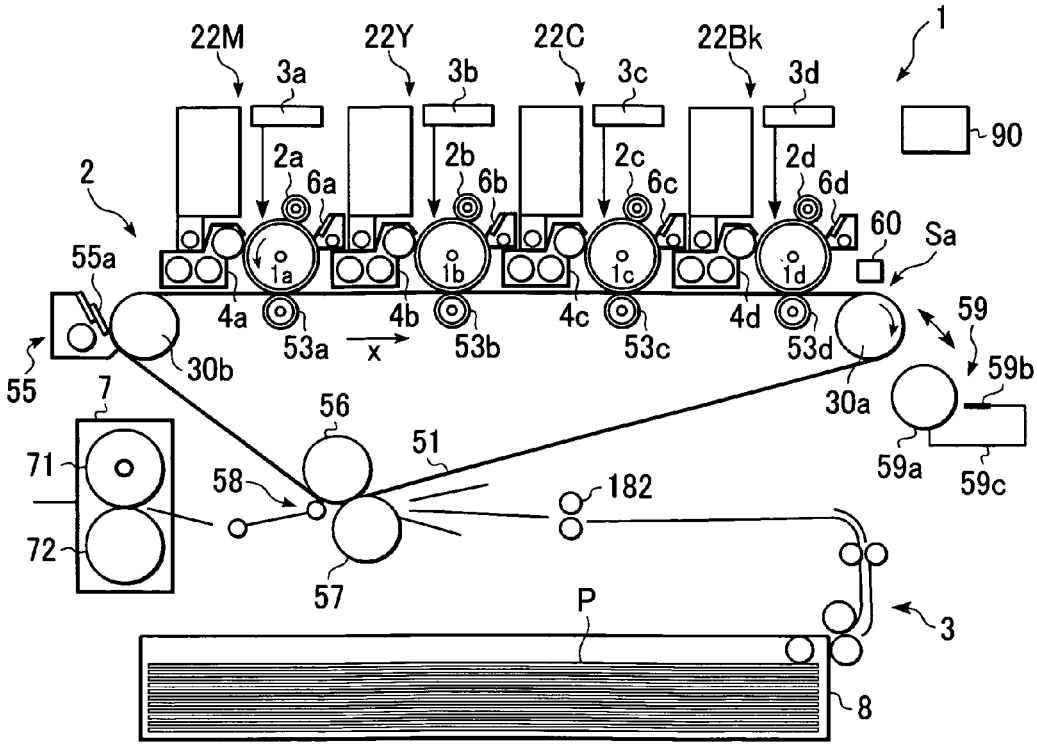
FIG. 1 is a schematic view of a color laser printer that is an example of an image forming apparatus according to a first embodiment of the present invention.

Embodiments of the present invention will be described in detail below by referring to the drawings.

FIG. 1 is a schematic view of a color laser printer 1 according to a first embodiment of the present invention. The color laser printer 1 includes a plurality of image forming units 2, a sheet delivery unit 3, and a fixing unit 7.

Each image forming unit 2 includes four stations 22M, 22Y, 22C, and 22Bk, for magenta (M), yellow (Y), cyan (C), and black (Bk), respectively, which are image forming means aligned in parallel, and an intermediate transfer belt 51, which is an endless intermediate transfer unit (image carrier) delivered in the X direction.

The stations 22M, 22Y, 22C, and 22Bk, respectively, include electrophotographic photoreceptive units (image carriers) (hereinafter referred to as photoreceptive drums) 1*a*, 1*b*, 1*c*, and 1*d*, scanners 3*a*, 3*b*, 3*c*, and 3*d*, primary chargers 2*a*, 2*b*, 2*c*, and 2*d*, developing units 4*a*, 4*b*, 4*c*, and 4*d* (which contain a magenta, yellow, cyan, and block toner (developer)), and cleaning blades 6*a*, 6*b*, 6*c*, and 6*d*.

The photoreceptive drums 1*a*, 1*b*, 1*c*, and 1*d* rotate counterclockwise in response to the image forming action of a driving motor not shown in the drawing. The scanners 3*a*, 3*b*, 3*c*, and 3*d* expose the photoreceptive drums 1*a*, 1*b*, 1*c*, and 1*d* to form electrostatic latent images on the surfaces of the photoreceptive drums 1*a*, 1*b*, 1*c*, and 1*d*.

The intermediate transfer belt 51, which is an image carrier, comes in contact with the photoreceptive drums 1*a*, 1*b*, 1*c*, and 1*d* of the stations 22M, 22Y, 22C, and 22Bk, which are disposed linearly above the intermediate transfer belt 51. The intermediate transfer belt 51 is stretched across a driving roller 30*a* and driven rollers 30*b* and 50 and rotates clockwise to form a color image. In this way, the toner images formed on the photoreceptive drums 1*a*, 1*b*, 1*c*, and 1*d* are transferred onto the intermediate transfer belt 51. In this embodiment, the intermediate transfer belt 51 is composed of a semiconductive polyimide.

Primary transfer rollers 53*a*, 53*b*, 53*c*, and 53*d*, which are primary transfer units, is in contact with the intermediate transfer belt 51 when an image is formed. The primary transfer rollers 53*a*, 53*b*, 53*c*, and 53*d* transfer the color toner images the photoreceptive drums 1*a*, 1*b*, 1*c*, and 1*d*, respectively, in this order onto the intermediate transfer belt 51. The overlapping toner images for each color that has been transferred onto the intermediate transfer belt 51 are further transferred onto a recording material P, which is a receptor (transfer medium), when the recording material P is delivered between a secondary transfer roller 57 and a driven roller 56, which are secondary transfer units 58.

The fixing unit 7 fixes the overlapping toner images transferred onto the recording material P and includes a fixing roller 71 for heating the recording material P and a pressurizing roller 72 for bonding the recording material P to the fixing roller 71. The fixing roller 71 and the pressurizing roller 72 deliver the recording material P having the overlapping toner images. When the recording material P passes through the fixing unit 7, heat and pressure are applied to fix the toner images onto the surface of the recording material P.

In this embodiment, a releasing oil such as silicone oil is applied to the surface of the fixing roller 71 so that the recording material P is easily released from the fixing roller 71.

When a color image is formed on the recording material P by using a color laser printer having the above-described structure, the photoreceptive drums 1*a*, 1*b*, 1*c*, and 1*d* are electrically charged and, then, are exposed with the scanners 3*a*, 3*b*, 3*c*, and 3*d* and polygon mirrors, not shown in the drawings, in response to image signals for color components sent from a controller, also not shown in the drawings. In this way, electrostatic latent images are formed on the surfaces of the photoreceptive drums 1*a*, 1*b*, 1*c*, and 1*d*.

Subsequently, each of the electrostatic latent images is developed by a magenta, yellow, cyan, and black toner to form a toner image on the photoreceptive drums 1*a*, 1*b*, 1*c*, and 1*d*. When the toner images reach the transfer region where each of the photoreceptive drums 1*a*, 1*b*, 1*c*, and 1*d* comes in contact with the intermediate transfer belt 51 as the photoreceptive drums 1*a*, 1*b*, 1*c*, and 1*d* rotate, a primary transfer bias voltage is applied by the primary transfer roller 53. As a result, the toner images on each of the photoreceptive drums 1*a*, 1*b*, 1*c*, and 1*d* are transferred to the intermediate transfer belt 51 rotating clockwise.

The toner images on the photoreceptive drums 1*a*, 1*b*, 1*c*, and 1*d* are transferred onto the rotating intermediate transfer belt 51 in the order of magenta, yellow, cyan, and black. In this way, a visible color image is formed on the intermediate transfer belt 51.

After a visible color image is formed on the intermediate transfer belt 51, a recording material P delivered from a paper delivery cassette 8 is supplied to the secondary transfer unit 58, which includes the secondary transfer roller 57 and the driven roller 56, by a resist roller 182. Then, a transfer bias voltage is applied to the secondary transfer roller 57 to transfer the visible color image onto the recording material P.

After the visible color image is transferred onto the recording material P, the recording material P is delivered from the secondary transfer unit 58 to the fixing unit 7. The recording material P is then heated and pressurized at the fixing unit 7 to fix the visible color image onto the recording material P. The recording material P with the fixed color image is then discharged into a discharge tray by discharge means, not shown in the drawing. To automatically form color images on both sides of the recording material P, the recording material P must by sent through a recording material reversing path, not shown in the drawing, to be reversed. Then, the reversed recording material P is sent to the secondary transfer unit 58 to form a color image on the back side of the recording material P.

Detecting means 60, illustrated in FIG. 1, detect color shifts of pattern images formed on the intermediate transfer belt 51 caused by an uneven delivery speed of the intermediate transfer belt 51 or a mistiming of the formation of each toner image. A controller, not shown in the drawing, controls the timing of image formation in accordance with signals detected by the detecting means 60.

The detecting means 60 are positioned furthest downstream of the traveling direction of the intermediate transfer belt 51 and are interposed between the photoreceptive drum 1*d*, which forms a black toner image, and the driving roller 30*a*. The detecting means 60 oppose a pattern image forming region Sa on the intermediate transfer belt 51.

Figure 2:
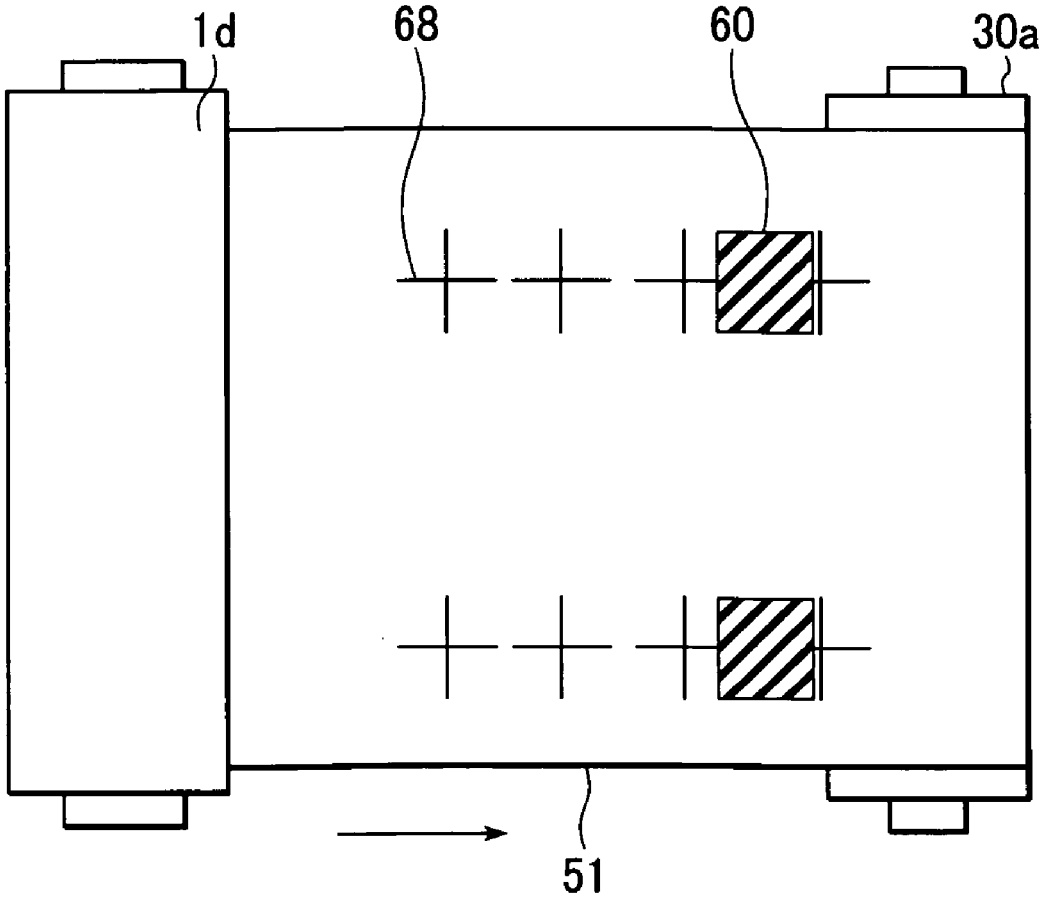
FIG. 2 illustrates the positions of pattern images for correcting the registration and detecting means of the color laser printer.

In this embodiment, as illustrated in FIG. 2, registration correction patterns 68 are formed on both edges of the intermediate transfer belt 51 so that the patterns are parallel to the traveling direction of the intermediate transfer belt 51. The detecting means 60 are disposed in positions where the registration correction patterns 68 can be read.

Next, correction of the registration of a color laser printer having the detecting means 60 will be described.

For correcting the registration, the registration correction patterns 68 corresponding to each of the colors are formed on the intermediate transfer belt 51 at a predetermined timing before image formation is started (cf. FIG. 2). Then, these registration correction patterns 68 are read by the detecting means 60 to detect color shifts in each of the photoreceptive drums 1*a*, 1*b*, 1*c*, and 1*d*, corresponding to different colors.

Then, it is determined whether or not the color shift is within a predetermined allowable limit. If the color shift exceeds the allowable limit, registration is corrected by electrically correcting image signals to correct the timing for starting the image formation or by correcting. In this way, color shift is minimized.

In this embodiment, pattern images (patch images) having a predetermined density are formed on the intermediate transfer belt 51 to improve the stability of the colors and the density of the overlapping toner images. Then, similar as to the above-mentioned method for detecting the registration correction patterns 68, density detectors (not shown in the drawings) are disposed above the intermediate transfer belt 51 to detect the density of the pattern images and to determine whether or not the density of the pattern images is within a predetermined limit. When the density greatly exceeds the limit, the density of the toner within the developer and/or the bias voltages applied to the primary chargers 2*a*, 2*b*, 2*c*, and 2*d* are adjusted.

When forming an image having an extremely small image ratio, degradation of the toner may be accelerated, causing an extreme decrease in the density. In such a case, the density may be stabilized by expelling all the toner inside the developing unit and then supplying new toner.

When these procedures are taken, however, a considerable amount of toner will remain on the intermediate transfer belt 51. In addition, when the recording material P is jammed (i.e., when the delivery of the recording material P fails and image formation stops), a considerable amount of toner remains on the intermediate transfer belt 51.

When a considerable amount of toner remains on the intermediate transfer belt 51, as described above, the toner images on the intermediate transfer belt 51 that are not transferred onto the recording material P may contaminate the secondary transfer roller 57 or a corona charging unit (not shown in the drawing) for charging the toner images on the surface of the intermediate transfer belt 51.

In this embodiment, an intermediate transfer belt cleaning unit 59, which is means for cleaning illustrated in FIG. 1, is disposed upstream of the secondary transfer roller 57 and downstream of the detecting means 60 in the traveling direction of the intermediate transfer belt 51.

The intermediate transfer belt cleaning unit 59 includes a metal roller 59*a* and a polyethylene terephthalate (PET) sheet 59*b*. The metal roller 59*a* has an external diameter of 16 mm and is a cleaning member that is capable of coming into and out of contact with the surface of the intermediate transfer belt 51. The polyethylene terephthalate (PET) sheet 59*b* has a thickness of 100 μm and scrapes off the toner that has contaminated the surface of the metal roller 59*a* by selectively being in contact with the metal roller 59*a*.

To clean the intermediate transfer belt 51 with the intermediate transfer belt cleaning unit 59, the metal roller 59*a* comes in contact with the intermediate transfer belt 51 and, then, a DC bias is applied.

The intermediate transfer belt cleaning unit 59 is not in contact with the intermediate transfer belt 51 during normal image formation.

When a DC bias is applied, the toner on the intermediate transfer belt 51 moves to the surface of the metal roller 59*a*. As a result, the toner on the intermediate transfer belt 51 is removed. After finishing cleaning the intermediate transfer belt 51 in this way, the metal roller 59*a* is separated from the intermediate transfer belt 51. Subsequently, the metal roller 59*a* comes in contact with the PET sheet 59*b* and rotates.

In this way, the toner that had moved from the intermediate transfer belt 51 to the surface of the metal roller 59*a* is scraped off by the PET sheet 59*b*. With the toner removed, the metal roller 59*a* becomes ready to clean the intermediate transfer belt 51 again. The toner scraped off is collected into a toner collector 59*c* included in the intermediate transfer belt cleaning unit 59.

Another cleaning required for the intermediate transfer belt 51 is cleaning the pattern images formed on the intermediate transfer belt 51 to be detected by the detecting means 60. After detection, the pattern images are cleaned by the intermediate transfer belt cleaning unit 59 that has been brought in contact with the intermediate transfer belt 51.

When the image formation is interrupted due to failure of delivery of the recording material P, toner may remain between the secondary roller 57 and the driving roller 30*a* of the intermediate transfer belt 51.

In such a case, the intermediate transfer belt 51 is rotated in the opposite direction to the normal rotational direction immediately after the image formation is interrupted or when the image formation is resumed to move the residual toner upstream of the intermediate transfer belt cleaning unit 59 in the normal traveling direction of the intermediate transfer belt 51. Then, the metal roller 59*a* is brought into contact with the intermediate transfer belt 51 being driven in the same direction as the traveling direction for normal image formation. At this time, a DC bias is applied to the metal roller 59*a* to remove the residual toner from the intermediate transfer belt 51.

Since the intermediate transfer belt cleaning unit 59 is disposed upstream of the secondary transfer roller 57, the pattern images and the residual toner on the intermediate transfer belt 51 can be removed before they reach the secondary transfer roller 57.

In other words, by disposing the intermediate transfer belt cleaning unit 59 downstream of the primary transfer roller 53 in the traveling direction of the intermediate transfer belt 51, the residual toner on the intermediate transfer belt 51 that is not going to be used for image formation on the recording material P can be removed more efficiently. Consequently, contamination of the secondary transfer roller 57 and the vicinity of the intermediate transfer belt 51 is minimized, and, thus, smearing of toner on the back side or the edges of the recording material P may be prevented.

According to this embodiment, by disposing a intermediate transfer belt cleaning unit 59 downstream of the detecting means 60 in the traveling direction of the intermediate transfer belt 51, the residual toner on the intermediate transfer belt 51 can be removed before reaching the secondary transfer roller, and, thus, detection by the detecting means 60 is not hindered.

In this embodiment, an auxiliary intermediate transfer belt cleaning unit 55 including a rubber blade 55*a* is disposed downstream of the secondary transfer roller 57 in the traveling direction of the intermediate transfer belt 51. The rubber blade 55*a* is pushed against the intermediate transfer belt 51 at an acute angle and completely removes the residual toner on the intermediate transfer belt 51 after a secondary transfer and the toner on the intermediate transfer belt 51 that was not removed by the intermediate transfer belt cleaning unit 59. In addition, an auxiliary cleaning unit such as a fur brush may be disposed upstream of the auxiliary intermediate transfer belt cleaning unit 55.

By using a metal roller 59*a* that has a resistive layer and a toner releasing layer on its surface for the intermediate transfer belt cleaning unit 59, the efficiency of cleaning can be improved.

Figure 3:
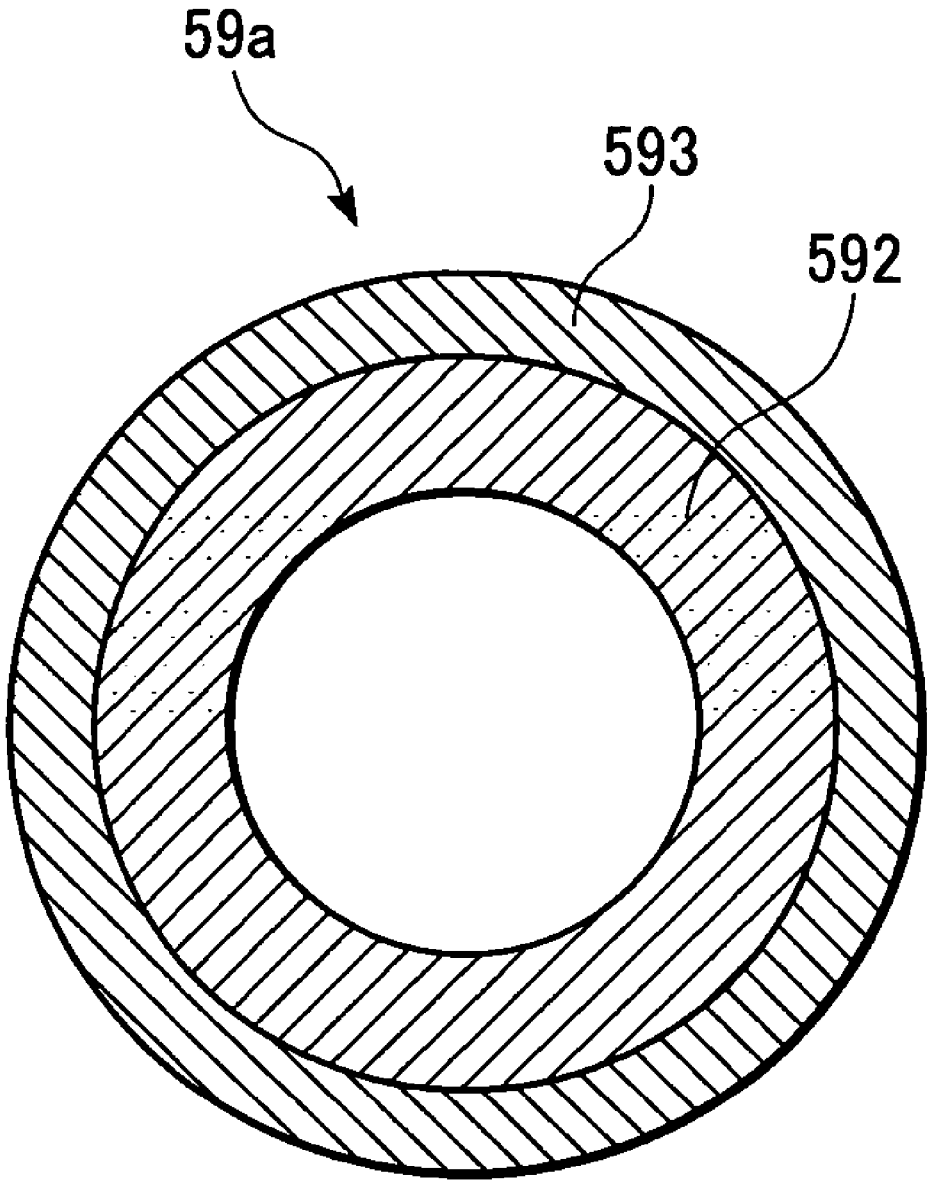
FIG. 3 is a cross-sectional view of a metal roller included in an intermediate transfer belt cleaning unit of the color laser printer.

More specifically, as illustrated in FIG. 3, the metal roller 59*a* is composed of a resistive layer 592 and a releasing layer 593. The resistive layer 592 is made up of a metal core having a diameter of 12 mm covered with an ethylene-propylene-diene (EPDM) rubber, whose resistance is adjusted to a volume resistivity of $1\times10^{6}$ to $1\times10^{10}$ Ωcm by dispersing carbon black. The releasing layer 592 is formed by coating the surface of the resistive layer 593 with polytetrafluoroethylene of a thickness of 10 μm.

By using a metal roller 59*a* having the above-mentioned structure, the toner images can be transferred more efficiently onto the metal roller 59*a* of the intermediate transfer belt cleaning unit 59. The resistive layer 592 prevents an electrical voltage from flowing into areas excluding the toner, and the releasing layer 593 removes the toner attached to the metal roller 59*a*. The resistive layer 592 and releasing layer 593 can be composed of any material if they fulfill the above-described functions.

Figure 4:
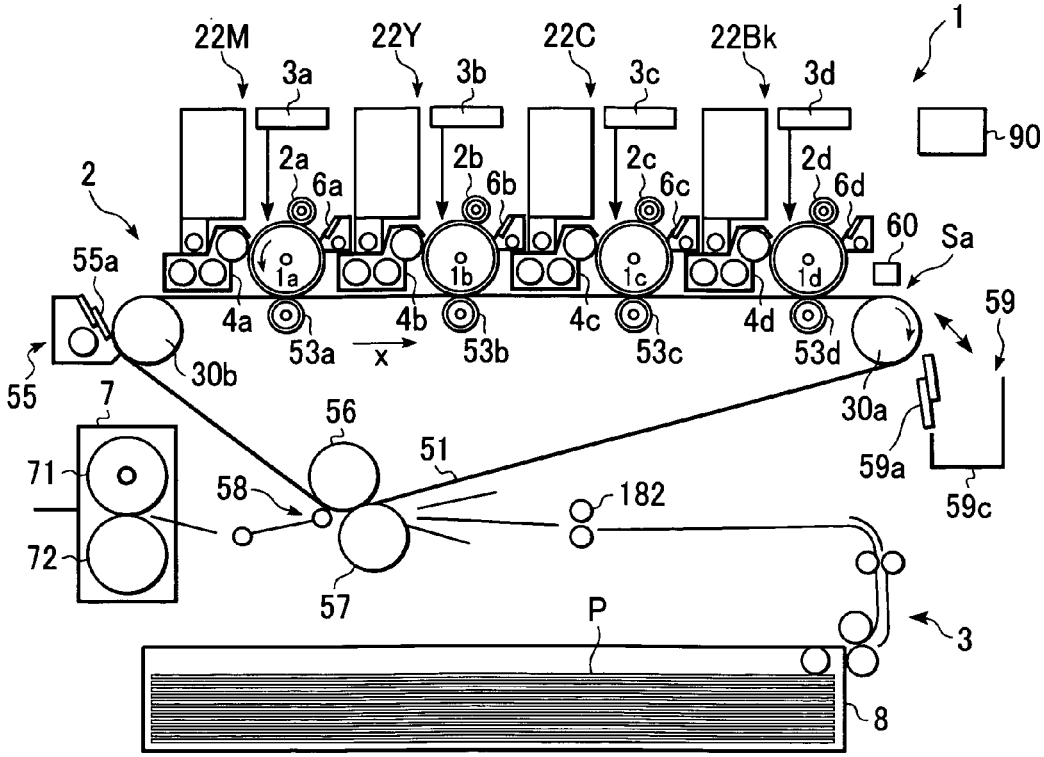
FIG. 4 is schematic view of another color laser printer.

In the above, the intermediate transfer belt cleaning unit 59 removes the toner from the intermediate transfer belt 51 by the metal roller 59*a*. Instead of the metal roller 59*a*, however, an elastic plate such as a rubber blade 59*d*, as illustrated in FIG. 4, that is capable of coming into and out of contact with the intermediate transfer belt 51 may be used to achieve the same cleaning effect.

Controlling means 90 controls the above-described cleaning action.

A second embodiment of the present invention will be described below.

Figure 5:
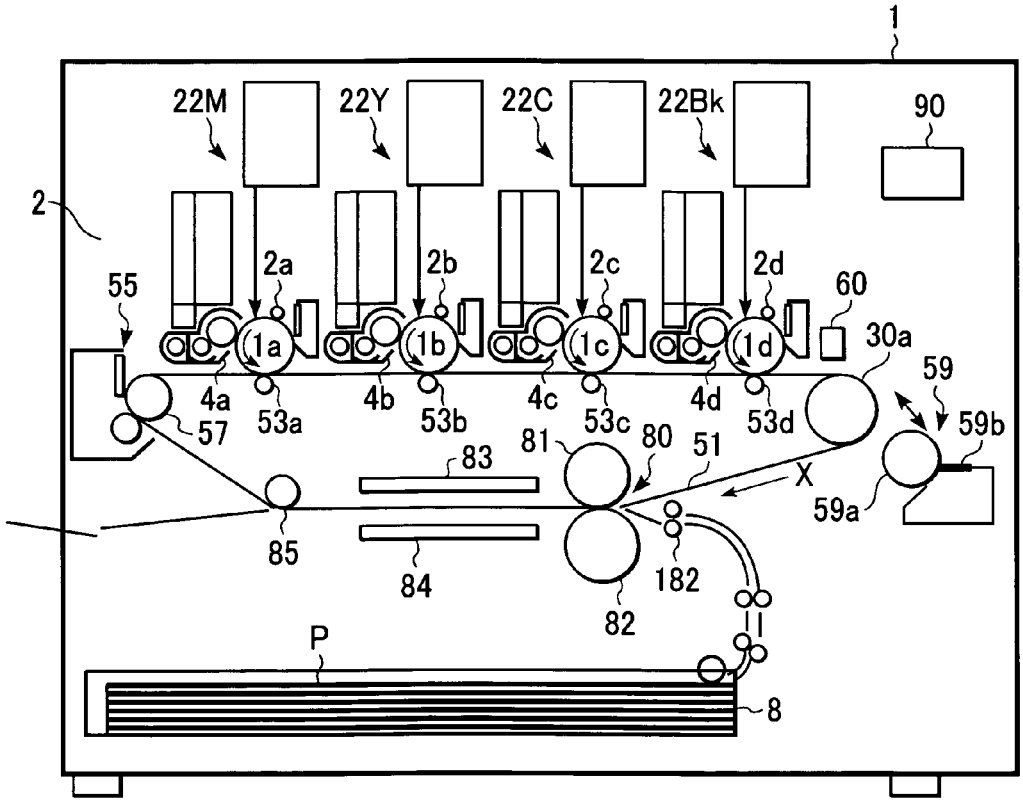
FIG. 5 is a schematic view of a color laser printer that is an example of an image forming apparatus according to a second embodiment of the present invention.

FIG. 5 is a schematic view of a color laser printer that is an example of an image forming apparatus according to an embodiment of the present invention. In FIG. 5, the reference numerals that are the same of those in FIG. 1 indicate the same or equivalent components as those illustrated in FIG. 1.

In FIG. 5, an intermediate transfer belt 51 is stretched across a tension roller 57 and a driving roller 30*a* so that the intermediate transfer belt 51 is moveable in the X direction and so that a predetermined tension is applied to a heating roller 81, a separation roller 85, and the intermediate transfer belt 51. In this embodiment, the intermediate transfer belt 51 is composed of polyimide with a thickness of 85 μm.

A pressurizing roller 82, which also functions as a secondary transfer roller, is disposed so that it opposes the heating roller 81 and so that the intermediate transfer belt 51 is interposed between the pressurizing roller 82 and the heating roller 81. The pressurizing roller 82 and the heating roller 81 make up a transfer and fixing unit 80.

When a recording material P is supplied between the intermediate transfer belt 51 and the pressurizing roller 82, toner images, which have already been transferred onto the intermediate transfer belt 51, are transferred onto the recording material P by the transfer and fixing unit 80. Then, the toner images transferred onto the recording material P are fixed by heating and pressurizing the recording material P.

After the recording material P is heated and pressurized at the transfer and fixing unit 80, the recording material P is cooled by coolers 83 and 84. Then, the recording material P is separated from the intermediate transfer belt 51 by a separation roller 85 and is discharged out of the image forming apparatus.

In this embodiment, the external diameter of the heating roller 81 and the pressurizing roller 82 is 45 mm. The heating roller 81 and the pressurizing roller 82 both include a heat source inside. The temperatures of the heat sources of the heating roller 81 and the pressurizing roller 82 are controlled so that they are 190° C. and 160° C., respectively. The nip of the heating roller 81 and the pressurizing roller 82 is 10 mm. The force applied between the two rollers 81 and 82 by a spring is adjusted to about 98 N.

In the above-described second embodiment, similar to the first embodiment, pattern images for preventing color shift and for stabilizing the density of the toner are formed on the intermediate transfer belt 51. The pattern images formed on the intermediate transfer belt 51 are detected by detecting means 60, and, then, controlling means 90 commands the relevant units to make necessary adjustments.

In this embodiment, similar to the first embodiment, an intermediate transfer belt cleaning unit 59 is disposed downstream of the detecting means 60 and upstream of the transfer and fixing unit 80 (i.e., upstream of the pressurizing roller 82) in the traveling direction of the intermediate transfer belt 51. In this way, contamination of the pressurizing roller 82 and the vicinity of the intermediate transfer belt 51 is minimized, and, thus, smearing of toner on the back side or the edges of the recording material is prevented.

By disposing the intermediate transfer belt cleaning unit 59 upstream of the transfer and fixing unit 80 in the traveling direction of the intermediate transfer belt 51, the residual toner on the intermediate transfer belt 51 is prevented from melting. In this way, formation of molten toner, which is extremely difficult to remove, is prevented.

Figure 6:
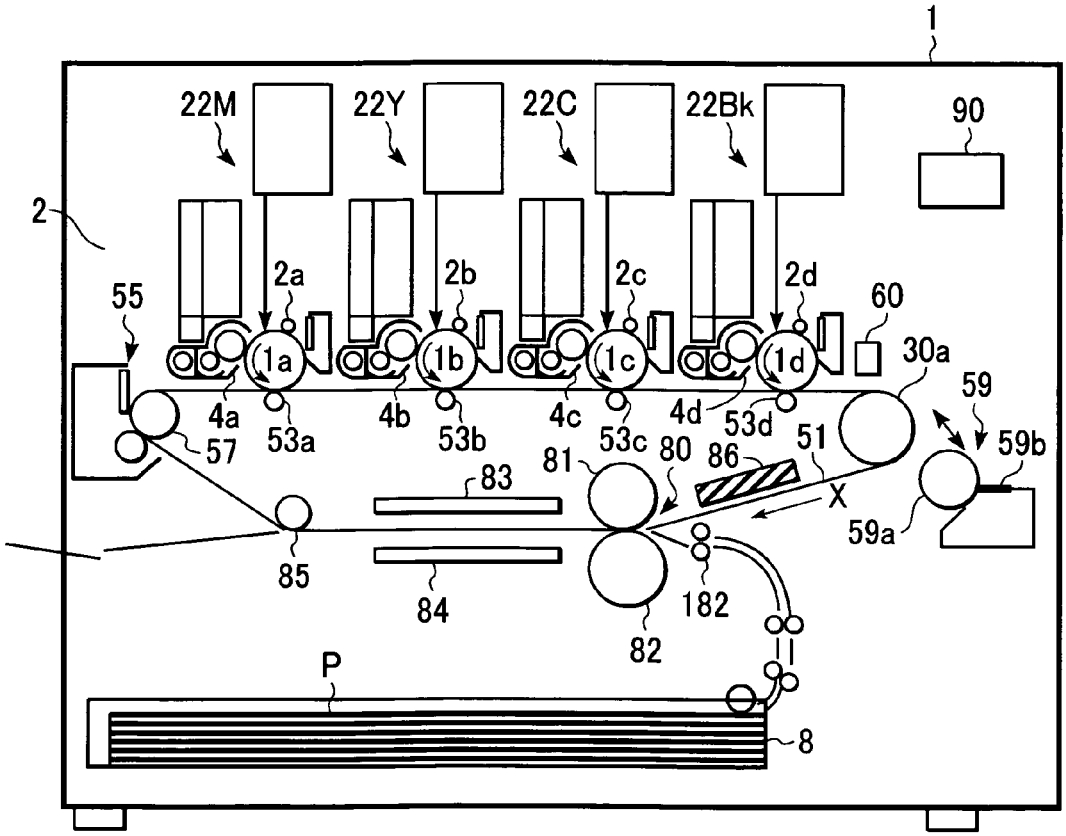
FIG. 6 is a schematic view of another color laser printer.

As illustrated in FIG. 6, there are color laser printers including a transfer and fixing unit 80 that also include a preliminary heating plate 86 for preheating toner images disposed upstream of the transferring and fixing unit 80 in the traveling direction of the intermediate transfer belt 51.

By including a preliminary heating plate 86, as described above, the toner images can be heated before being heated and pressurized by the heating roller 81 and the pressurizing roller 82, respectively. In this way, the toner is melted and failure of fixing at the transfer and fixing unit 80 can be prevented. The temperature of the preliminary heating plate 86 is adjusted to about 180° C.

When the preliminary heating plate 86 is disposed, the intermediate transfer belt cleaning unit 59 should be disposed upstream of the preliminary heating plate 86 in the traveling direction of the intermediate transfer belt 51. By disposing the intermediate transfer belt cleaning unit 59 in such a position, contamination of the pressurizing roller 82 and the vicinity of the intermediate transfer belt 51 is minimized, and, thus, smearing of toner on the back side or the edges of the recording material P is prevented.

A third embodiment according to the present invention will be described below.

Figure 7:
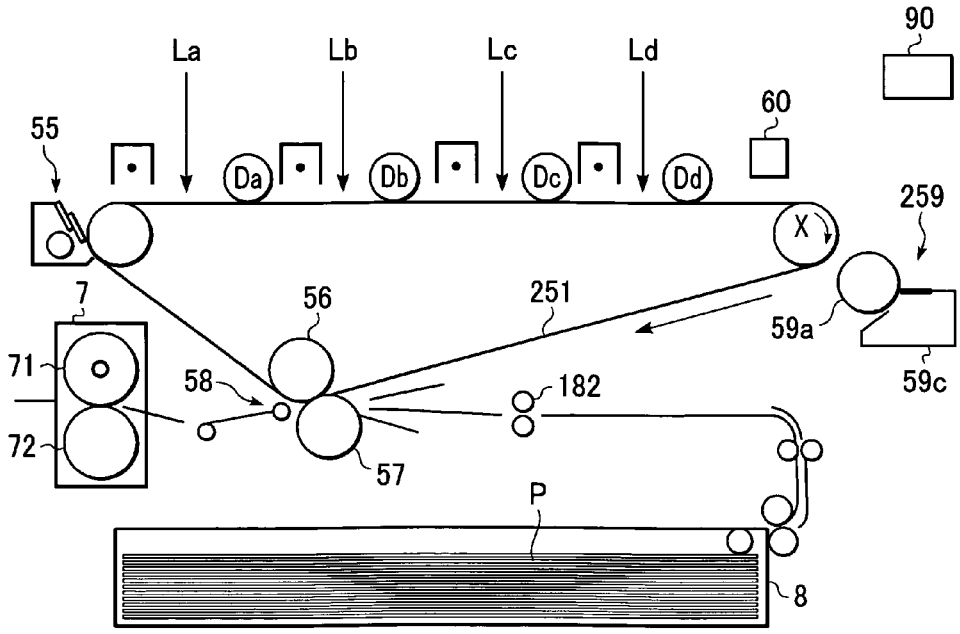
FIG. 7 is a schematic view of a color laser printer that is an example of an image forming apparatus according to a third embodiment of the present invention.
Figure 8:
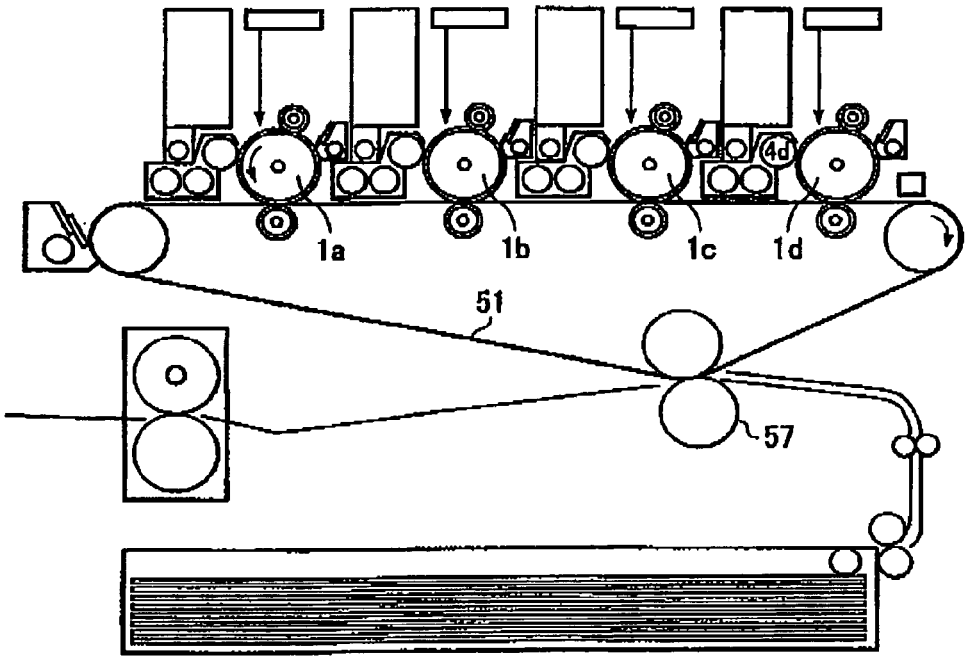
FIG. 8 PRIOR ART
FIG. 8 is a schematic view of a known color laser printer.
Figure 9:
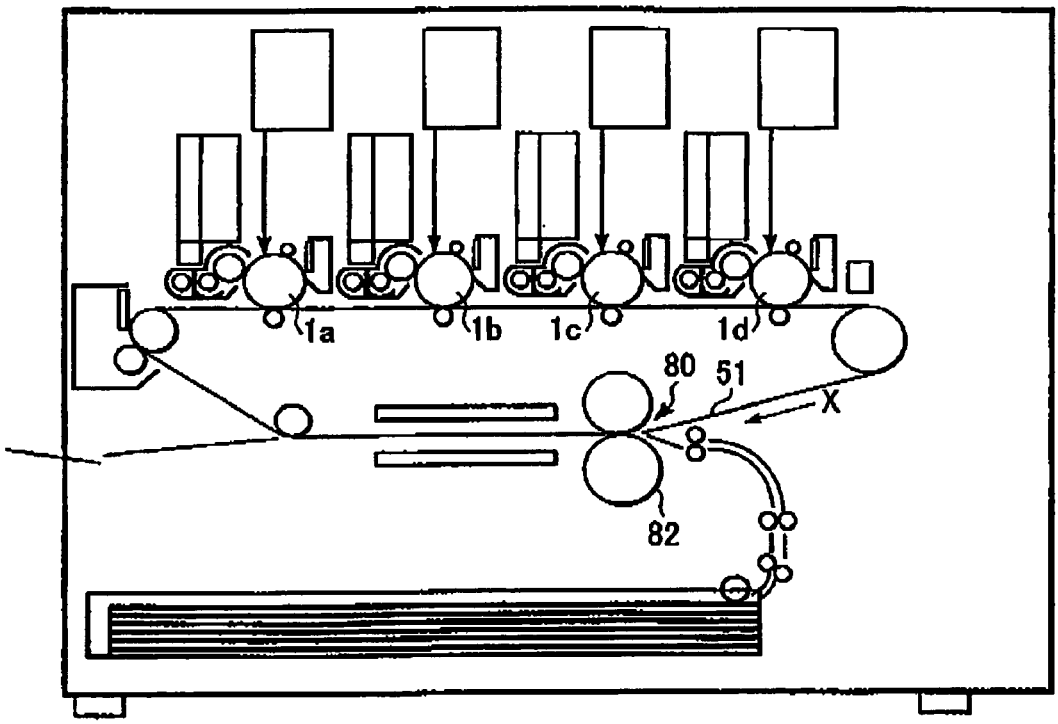
FIG. 9 PRIOR ART
FIG. 9 is a schematic view of another known color laser printer.

FIG. 7 is a schematic view of a color laser printer that is an example of an image forming apparatus according to an embodiment of the present invention. In FIG. 7, the reference numerals that are the same of those in FIG. 1 indicate the same or equivalent components as those illustrated in FIG. 1.

In FIG. 7, the image forming apparatus according to this embodiment includes a photoreceptive belt 251, on which the toner images are formed. The photoreceptive belt 251 is a rotatable, endless image carrier. The image forming apparatus according to this embodiment develops multiple toner images on the photoreceptive belt 251 by carrying out development at each developing unit Da to Dd. Then, the toner images are simultaneously transferred onto a recording material P. Subsequently, a fixing unit 7 fixes the toner images onto the recording material P.

A photoreceptive belt cleaning unit 259 includes a metal roller 59*a* for cleaning the surface of the photoreceptive belt 251 on which the toner images are formed. The photoreceptive belt cleaning unit 259 is disposed upstream of a secondary transfer roller 57 and downstream of detecting means 60 in the traveling direction of the photoreceptive belt 251.

By disposing the photoreceptive belt cleaning unit 259 in such a position, the residual toner on the photoreceptive belt 259 not used for forming an image on the recording material P can be removed more efficiently. Accordingly, contamination of the secondary transfer roller 57 and the vicinity of the photoreceptive belt 251 is minimized, and, thus, smearing of toner on the back side or the edges of the recording material P is prevented.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

a movable image bearing member;

toner image forming means for forming a normal toner image to be transferred to a recording medium and a toner patch facilitating detection on the moving image bearing member;

a transfer member transferring the normal toner image on the image bearing member onto the recording medium;

a detecting member detecting the toner patch on the image bearing member; and a cleaning member disposed downstream to the detecting member and upstream to the transfer member in a moving direction of the image bearing member, the cleaning member contacting the image bearing member so as to remove the toner patch from the image bearing member when the toner patch is in an area in which toner patches are removed from the image bearing member, and the cleaning member being out of contact with the image bearing member when the normal toner image is in the area.

2. The image forming apparatus according to claim 1, wherein a voltage is applied to the cleaning member, and wherein the cleaning member includes a releasing layer and a resistive layer beneath the releasing layer.

3. The image forming apparatus according to claim 1, wherein the transfer member comprises a heating member.

4. The image forming apparatus according to claim 3 further comprising an auxiliary heating member disposed upstream to the transfer member in the moving direction of the image bearing member, wherein, the cleaning member is disposed downstream to the detecting member and upstream to the auxiliary heating member in the moving direction of the image bearing member.

* * * * *